United States Patent [19]

Hoyland

[11] Patent Number: 4,534,149

[45] Date of Patent: Aug. 13, 1985

[54] MACHINE FOR CLOSING FILLED BAGS

[75] Inventor: Trevor B. Hoyland, Norfolk, England

[73] Assignee: Thurne Engineering Co. Ltd., Norwich, England

[21] Appl. No.: 614,938

[22] Filed: May 29, 1984

[30] Foreign Application Priority Data

May 27, 1983 [GB] United Kingdom ..... 8314764

[51] Int. Cl.[3] ..... B65B 7/08

[52] U.S. Cl. ..... 53/76; 53/138 A; 53/131; 53/139.3; 53/378; 493/223

[58] Field of Search ..... 53/138 A, 139.3, 419, 53/417, 378, 131, 76, 75; 493/214, 223, 255, 493/962, 347, 382

[56] References Cited

U.S. PATENT DOCUMENTS

| | | | |
|---|---|---|---|
| 1,551,525 | 8/1925 | Hamer | 53/138 A X |
| 3,587,204 | 6/1971 | George | 53/138 A |
| 3,740,921 | 6/1973 | Meyer | 53/138 A X |
| 4,191,004 | 3/1980 | Gmuer et al. | 53/378 |
| 4,328,654 | 5/1982 | Van Ginkel et al. | 53/138 A X |

*Primary Examiner*—James F. Coan

*Attorney, Agent, or Firm*—Sughrue, Mion, Zinn, Macpeak and Seas

[57] ABSTRACT

A bag tying machine comprises a guide (17, 18) which receives the open end part of a filled bag as it is moved through the machine, a follow-up member (29) which is movable adjacent the guide (17, 18) following a bag to gather together the open end of the bag, and means (39, 40, 43) for supplying a length of pressure sensitive adhesive tape and holding it across the path of the gathered together end of the bag. The machine also includes a pair of pivoted arms (20, 21) having a first pair of jaws (30, 31), upstream from the length of pressure sensitive adhesive tape and against which the gathered together end of the bag is initially compressed, and a second pair of jaws (34, 35) immediately downstream of the adhesive tape which support the adhesive tape as the gathered together neck of the bag is urged into contact with it and which then clamp the adhesive tape around the gathered together neck of the bag to tie it together.

14 Claims, 3 Drawing Figures

MACHINE FOR CLOSING FILLED BAGS

BACKGROUND OF THE INVENTION

Our earlier British patent specification GB-A-No. 1,381,871 describes and claims a machine for closing filled bags by applying an adhesive tape tie to the gathered together open end of such a bag. The machine described in this earlier specification includes a stop movable between a retracted position and an advanced position in which it extends into the path of the open end part of the bag and against which the end part of the bag is compressed to gather it together. The stop then moves to its retracted position together with the compressed end part of the bag and in so doing transfers the compressed and gathered together end part of the bag into contact with the adhesive tape used to form the tie. The machine also includes clamping means to clamp the adhesive tape around the gathered together neck of the bag and subsequently release the closed end part of the bag to allow it to be moved out of the guide. The clamping means disclosed in our earlier specification includes a pair of spring-loaded jaws which in one example move forwards and backwards in the direction of movement of the gathered together end part of the bag and in the other example are fixed downstream from the adhesive tape in the direction of movement of the bag.

Our British patent specification GB-A-No. 1,517,031 which is a patent of addition to the earlier specification also describes a bag tying machine but in the example described in this specification the stop is omitted and the end of the bag is gathered together against the adhesive tape which is supported directly by the clamping means. This arrangement is, in general, successful in operation but the adhesive tape may not be sufficiently supported by the clamping means to prevent it being distorted as the end of the bag is gathered together against it. When the adhesive tape is distorted in this way, the adhesive tape tie is incorrectly formed.

SUMMARY OF THE INVENTION

According to this invention a bag tying machine comprising a guide which receives the open end part of a filled bag as it is moved through the machine, a follow-up member which is movable adjacent the guide following a bag to gather together the open end of the bag, and means for supplying a length of pressure sensitive adhesive tape and holding it across the path of the gathered together end of the bag, also includes a pair of pivoted arms having a first pair of jaws upstream from the length of pressure sensitive adhesive tape and against which the gathered together end of the bag is initially compressed, and a second pair of jaws immediately downstream of the adhesive tape which support the adhesive tape as the gathered together neck of the bag is urged into contact with it and which then clamp the adhesive tape around the gathered together neck of the bag to tie it together.

Preferably the means for supplying a length of pressure sensitive adhesive tape and holding it across the path of the gathered together neck of the bag as the latter is moved along the guide include a carrier for a reel of adhesive tape, a pair of rolls through the nip of which adhesive tape passes, a cutter downstream from the rolls, and a gripper which reciprocates back and forth across the path of the bag through the machine and which is arranged to grip a free end of the adhesive tape and draw a length of the tape from the reel across the path of the gathered together end of the bag as it moves through the machine. The cutter is arranged to sever the adhesive tape to form a tie as the adhesive tape is clamped around the gathered together neck of the bag.

Preferably a device is also provided for applying spaced lengths of non-adhesive strip at intervals to the adhesive tape on its passage from the reel to the gripper. The cutter is then arranged to cut through the middle of each spaced length of non-adhesive strip that has been applied. Thus, both ends of each tie have non-adhesive strip covering them so that tabs are formed at each end which can later be gripped by the eventual purchaser of the filled bags to enable them to remove the adhesive strip easily. Preferably the pair of arms include an opening between the first and second pair of jaws through which the gripper reciprocates and through which the free end of the adhesive tape is drawn. Preferably the machine also includes a printing head which is arranged to print on the non-adhesive side of the adhesive tape on its passage from the reel to the gripper. The printing head is used to print information relating to the package on the adhesive tape so that it appears on each tie. This enables the packaging date or the intended use by date together with information on prices, weight and content to be printed onto each tie.

Preferably the guide is formed by a pair of endless belts having a converging entry and a downstream portion in which they are in contact with one another and move together. The open end of the bags may be arranged to be directed into the converging entry by a pair of counter-rotating brushes upstream from the entry.

Preferably the bag tying machine also includes a subsidiary clamp located on the side of the first jaws remote from the filled bag and arranged to engage the open end of the filled bag. This subsidiary clamp clamps the free end of the neck of the bag as the neck is gathered together against the first pair of jaws and prevents the free end of the gathered together neck of the bag from being pulled sideways around the jaws by the follow-up member and hence miss the adhesive tape altogether. Naturally, the subsidiary clamp releases the free end of the filled bag as the gathered together neck of the bag is passing through the clamping means and having the adhesive tape tie formed around it.

Preferably the follow up memeber is arranged to be raised so that it is aligned with the guide to follow a bag and gather together its open end and arranged to be lowered so that it can return away from the path of the bag along the guide. The machine preferably includes a bag detector to detect the presence of the open end part of a bag in the guide and to raise the follow up member only when the presence of the open end part of the bag has been detected and to initiate a bag tying operation only when the presence of the open end of the filled bag has been detected in the guide. The provision of the bag detector ensures that if a filled bag is absent from a stream of filled bags approaching the bag tying machine or, alternatively, if for some reason the open end of a filled bag is not correctly located in the guide, the bag tying machine does not go through a bag tying operation without the bag being present since this can lead to the adhesive tape tying mechanism being disabled by an accumulation of adhesive tape around the gripper or clamping jaws. Preferably the bag detector comprises a spring biased, pivoted depending arm which is located in between the guides and a proximity switch, the bag, on passage along the guide causing the arm to pivot and cause the proximity switch to change its state so initiating a bag tying operation.

BRIEF DESCRIPTION OF THE DRAWINGS

A particular example of a bag tying machine in accordance with this invention will now be described with reference to the accompanying drawings, in which.

DESCRIPTION OF PARTICULAR EXAMPLE

Figure 1:
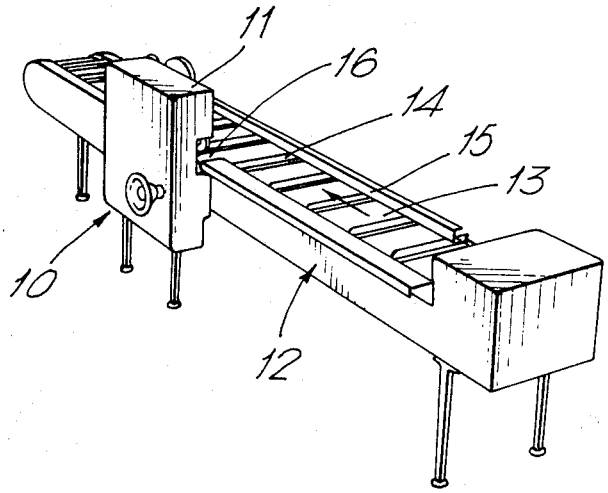
FIG. 1 is a general perspective view of the machine mounted alongside a conveyor for carrying filled bags.

A bag tying machine 10 enclosed by a casing 11 is mounted at one side of a conveyor 12 which is formed by a surface 13 with flights 14 moving over the surface 13. A curb 15 is located on the opposite side of the conveyor 12 and is arranged to position filled bags laying horizontally on the surface 13 so that their open end parts enter an aperture 16. The open end parts of the filled bags are guided into the aperture 16 by a pair of counter-rotating brushes (not shown).

Figure 2:
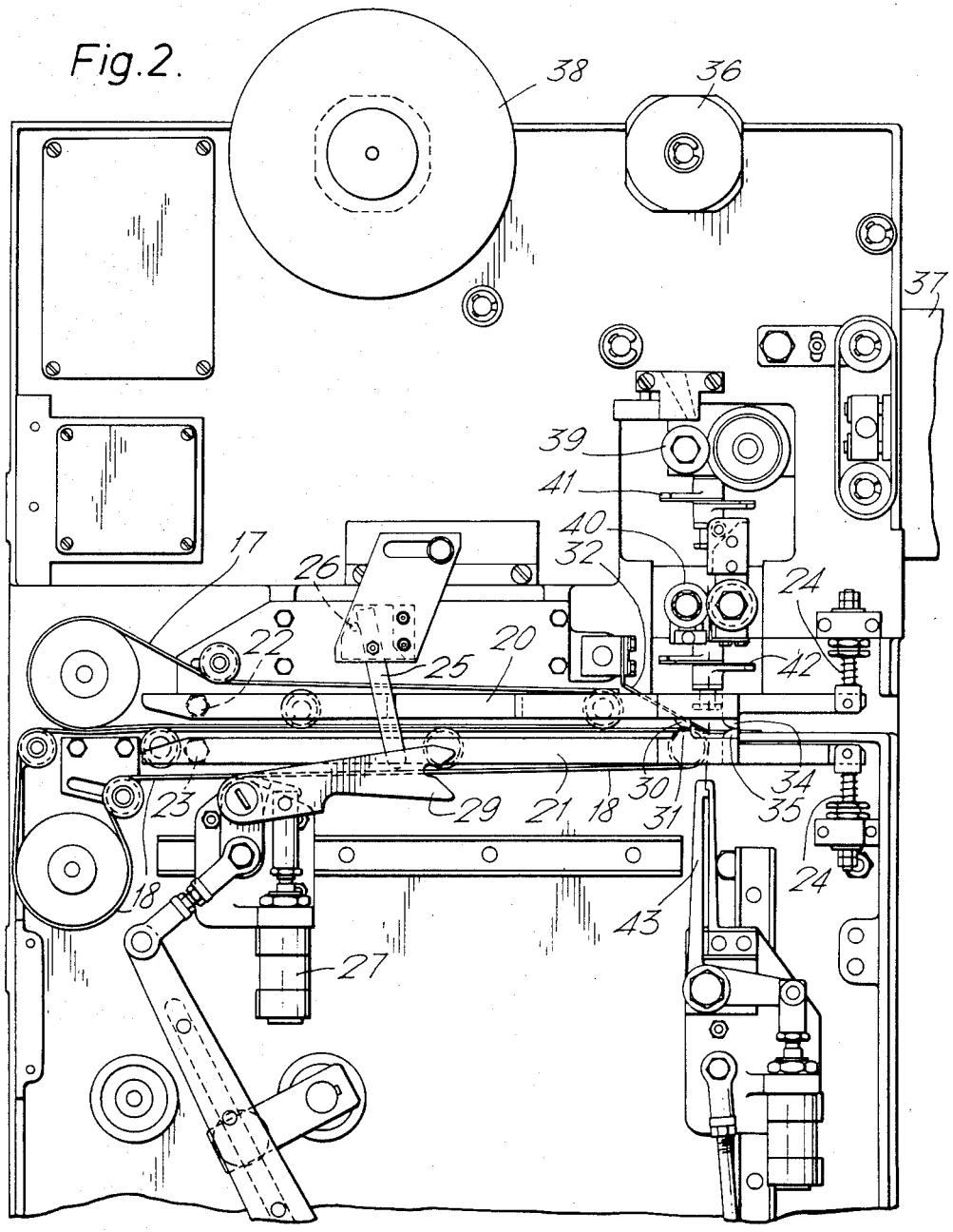
FIG. 2 is a front elevation of the machine.
Figure 3:
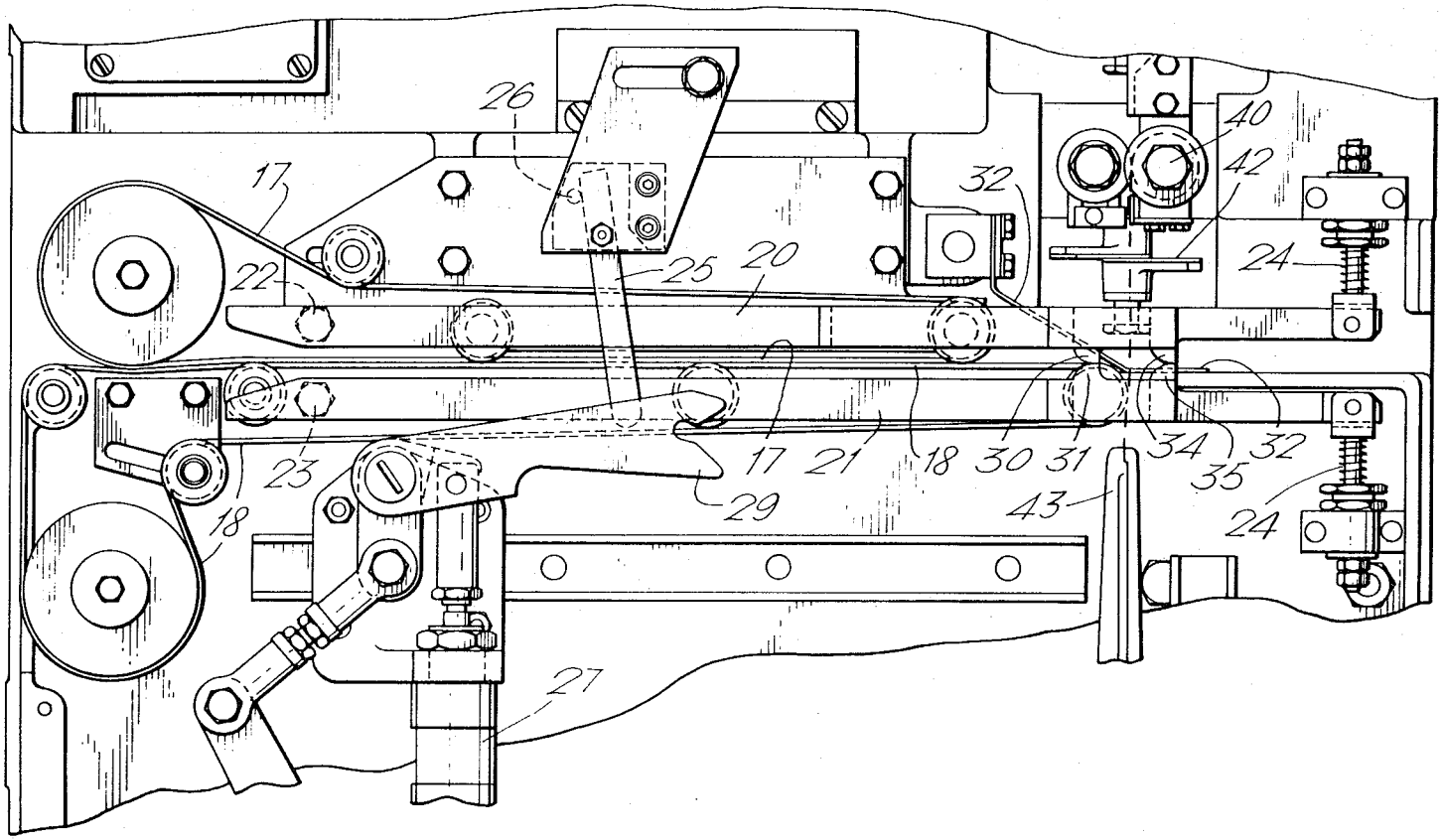
FIG. 3 is a side elevation to a larger scale of the main parts of the machine.

The bag tying machine includes a pair of endless belts 17 and 18 which come together to form a nip and act as a guide to receive the open end of the filled bag. The pair of arms 20 and 21 which are pivoted around pivots 22 and 23 respectively, also help to define a guide between which the gathered together open neck of the bag passes. The arms 20 and 21 are spring loaded and biased towards one another by springs 24. As the gathered together open end of the bag is drawn between the nip of the belts 17 and 18, opposite sides of the bags are drawn together. The presence of the bag is detected by an arm 25 which hangs down between the arms 20 and 21 and the belts 17 and 18 under gravity and which is pivoted to the right, as seen in FIGS. 2 and 3, by passage of a bag. Pivoting of the arm 25 is detected by a proximity detector 26. Upon detection of the open end of a filled bag, a pneumatic ram 27 is actuated to raise a follow up member 29 so that it is aligned with the path of the bag in the nip between the belts 17 and 18. The follow up member 29 is then moved towards the right, as seen in FIGS. 2 and 3, at a rate faster than the belt speed of the belts 17 and 18, and as it moves forwards from behind the open neck of the bag gathers it together. The leading end of the bag is engaged by a first pair of jaws 30 and 31 formed on the arms 20 and 21 and further movement of the follow up member 29 compresses the end of the bag against the jaws 30 and 31 to gather it together. As the follow up member 29 reaches the jaws 30 and 31 a pneumatic ram (not shown) is actuated to move a subsidiary clamp 32 downwards so that it clamps the free end of the filled bag in position. Further forwards movement of the follow up member 29 urges the gathered together neck of the bag between the jaws 30 and 31 and, as this occurs, the arms 20 and 21 pivot apart against the bias of the springs 24 and move the gathered together end of the filled bag against the strip of adhesive tape which is supported by a second pair of jaws 34 and 35 also attached to the arms 20 and 21. Further movement of the follow up member 29 urges the gathered together neck of the bag between the jaws 34 and 35 and in so doing wraps the adhesive tape around the gathered together neck of the bag to complete the tie around the open end of the gathered together neck of the bag. Again, as the gathered together neck of the bag is urged between the jaws 34 and 35 the arms 20 and 21 pivot against the bias of their springs 24.

The adhesive tape supply mechanism including adhesive tape supply reel 36 printer unit 37, paper tape supply reel 38, feed rolls 39 and 40, cutters 41 and 42 and a gripper unit 43 are conventional in construction and substantially are described in our earlier specifications GB-A-No. 1,381,871 and GB-A-No. 1,517,031.

As the completed tie is passing between the second pair of jaws 34 and 35 the pneumatic ram is deactuated to release the subsidiary clamp 32 and thereby release the free end of the filled bag and also the gripper unit 43 is operated to move the grippers 43 through an aperture formed in the arms 20 and 21 to grip the free end of adhesive tape from the reel 36 and pull this free end down so that it is held across the path of the gathered together neck of the bag. Paper tape from the reel 38 is adhered in spaced lengths to the adhesive tape as fully described in our earlier specifications. The follow up-member 29 returns to its initial position and the pneumatic ram 27 is deactuated so that it returns out of the path of the following gathered together neck of the bag and then the cycle is repeated.

I claim:

1. A bag tying machine comprising a guide, said guide receiving an open end part of a filled bag as it is moved through the machine to be tied, a follow-up member, said follow-up member being movable adjacent said guide following said open end part of a bag to gather it together, tape supply means for supplying a length of pressure sensitive adhesive tape and holding it across a path of said gathered together end of the bag, and a pair of pivoted arms, located on opposite sides of said path of said gathered together end of said bags through said machine whereby said gathered together neck of said bag passes between said pair of arms, said pair of pivoted arms including a first and a second pair of jaws, said first pair of jaws being located upstream from said length of pressure sensitive adhesive tape and said gathered together end of said bag being initially compressed against them, said second pair of jaws being located immediately downstream from said adhesive tape, and supporting said adhesive tape as said gathered together neck of said bag is urged into contact with said adhesive tape, said second pair of jaws clamping said adhesive tape around said gathered together neck of said bag to tie it together as said follow-up member urges said gathered together neck between them.

2. The machine of claim 1, wherein said tape supply means includes a carrier for a reel of adhesive tape, a pair of rolls, said pair of rolls coming together to form a nip, said adhesive tape passing through said nip, a cutter, said cutter being located downstream from said rolls, and a gripper, said gripper reciprocating back and forth across said path of said bag through said machine, and said gripper being adapted to grip a free end of said adhesive tape and draw a length of said tape from said reel across said path of said gathered together end of said bag, said cutter being arranged to sever said adhesive tape to form said tie as said adhesive tape is clamped around said gathered together neck of said bag.

3. The machine of claim 2, wherein paper applying means are also provided for applying spaced lengths of non-adhesive strip at intervals to said adhesive tape on its passage from its said reel to said gripper and wherein said cutter is arranged to cut through each spaced length of non-adhesive strip whereby said gripper grips said free end of said adhesive tape to which a section of non-adhesive strip has been applied.

4. The machine of claim 3, wherein said pair of arms each include apertures between said first and second pairs of jaws, said gripper reciprocating through said apertures and drawing said free end of said adhesive tape through said apertures.

5. The machine of claim 1, which also includes a subsidiary clamp, said subsidiary clamp being located on a side of said first pair of jaws remote from said filled bag and said subsidiary clamp being arranged to engage said open end of said filled bag, said subsidiary clamp clamping said free end of said bag as said neck is gathered together against said first pair of jaws and thereby preventing said free end of said bag being pulled sideways around said first pair of jaws by said follow-up member and hence missing said adhesive tape.

6. The machine of claim 2, which also includes a printing head, said printing head being arranged to print on a non-adhesive side of said adhesive tape on its passage from said reel to said gripper.

7. The machine of claim 1, wherein said guide is formed by a pair of endless belts, said endless belts having a converging upstream entry, and a downstream portion, said belts being in contact with one another in said downstream portion and moving together to convey said neck of said bag in said forwards direction.

8. The machine of claim 1, wherein said follow-up member is pivoted and said machine includes means to raise and lower said follow-up member, said follow-up member being raised whereby said follow-up member is aligned with said guide to follow a bag and gather together its open end and being lowered whereby said follow-up member returns away from said path of said bag along said guide.

9. The machine of claim 8, further including bag detector means, said bag detector means detecting the presence of said open end of said bag in said guide, said bag detector means operating said means to raise said follow-up member and initiating said bag tying operation only when the presence of said open end of said filled bag has been detected in said guide.

10. The machine of claim 9, wherein said bag detector means includes a pivoted, spring-biassed depending arm, and a proximity switch, said arm hanging downwards and projecting into said path of movement of said bag necks and being pivoted away from said guide by movement of said open end of said bag along said guide, said movement of said arm being detected by said proximity switch to initiate said operation of said follow-up member and said bag tying operation.

11. The machine of claim 5, wherein said guide is formed by a pair of endless belts, said endless belts having a converging upstream entry, and a downstream portion, said belts being in contact with one another in said downstream portion and moving together to convey said neck of said bag in said forwards direction.

12. The machine of claim 5, wherein said follow-up member is pivoted and said machine includes means to raise and lower said follow-up member, said follow-up member being raised whereby said follow-up member is aligned with said guide to follow a bag and gather together its open end and being lowered whereby said follow-up member returns away from said path of said bag along said guide.

13. The machine of claim 12, further including bag detector means, said bag detector means detecting the presence of said open end of said bag in said guide, said bag detector means operating said means to raise said follow-up member and initiating said bag tying operation only when the presence of said open end of said filled bag has been detected in said guide.

14. The machine of claim 13, wherein said bag detector means includes a pivoted, spring-biassed depending arm, and a proximity switch, said arm hanging downwards and projecting into said path of movement of said bag necks and being pivoted away from said guide by movement of said open end of said bag along said guide, said movement of said arm being detected by said proximity switch to initiate said operation of said follow-up member and said bag tying operation.

* * * * *